United States Patent [19]

Simms

[11] Patent Number: 4,609,116

[45] Date of Patent: Sep. 2, 1986

[54] PRODUCE BIN

[75] Inventor: Stanton E. Simms, Ceres, Calif.

[73] Assignee: Calpine Containers, Inc., Modesto, Calif.

[21] Appl. No.: 729,378

[22] Filed: May 1, 1985

[51] Int. Cl.[4] ..... B65D 19/16

[52] U.S. Cl. ..... 217/12 R; 206/600; 220/4 F; 217/43 R; 217/69

[58] Field of Search ..... 217/12 R, 43 R, 69; 220/4 F; 206/600; 108/55.1

[56] References Cited

U.S. PATENT DOCUMENTS

| | | | |
|---|---|---|---|
| 2,775,361 | 12/1956 | Kasdan | 217/12 R |
| 3,159,300 | 12/1964 | Coffey . | |
| 3,182,847 | 5/1965 | Fuller | 217/12 R |
| 3,243,245 | 3/1966 | Kewley | 217/12 R |
| 3,262,597 | 7/1966 | Coffey . | |
| 3,323,674 | 6/1967 | Nist . | |
| 3,342,364 | 9/1967 | Bingham et al. | 217/12 R |
| 3,705,663 | 12/1972 | Schubert et al. . | |
| 3,958,712 | 5/1976 | Martin . | |
| 4,024,977 | 5/1977 | Rowley | 217/12 R |
| 4,171,058 | 10/1979 | Collins . | |
| 4,174,045 | 11/1979 | Heller et al. | 220/4 F |
| 4,453,471 | 6/1984 | Harrington et al. | 217/12 R |
| 4,461,395 | 7/1984 | Burnett | 217/12 R |

FOREIGN PATENT DOCUMENTS 97125 2/1961 Netherlands .

*Primary Examiner*—Joseph Man-Fu Moy

*Attorney, Agent, or Firm*—Townsend and Townsend

[57] ABSTRACT

A bulk container which is disassemblable such that the interchangeable wall panels and the locking clips which connect the wall panels fit flatly into the flanged base assembly of the container. A base assembly provided with flanged sides holds the disasembled rectangular side panels. Each side panel is provided with a miter strip adjacent each side edge which extends below the lower edge in a leg. The leg supports the panel above the flange of the base assembly. Adjacent the miter strip at each side of the panel is a short slot. Locking clips engage a pair of panels at each corner by engaging the slots. The size reduction afforded by the disassembled condition of the container provides for more efficient shipping and transportation of the containers. Interchangeable parts reduce overall costs and the time required for assembly and disassembly.

8 Claims, 4 Drawing Figures

PRODUCE BIN

The present invention relates to an improved portable and disassemblable bulk container having interchangeable parts and improved safety features.

BACKGROUND OF THE INVENTION

A number of bulk containers have been proposed which can be knocked down when empty to conserve space. Exemplary of such containers are those disclosed in U.S. Pat. Nos. 4,171,058; 3,705,663; 3,323,674; and 3,262,597.

Efficiency and economy are greatly enhanced by having completely disassemblable and interchangeable part for such containers. When the containers are empy, shipping costs are greatly reduced if the knocked-down containers can be stacked and efficiently shipped in their more compact form. However, the various parts of the knocked-down containers can be cumbersome to transfer from one point to another and reassemble, since there is always the possibility of losing or damaging individual parts when the containers are moved. Fork lifts are commonly used to load and unload the containers both when full and in their disassembled condition. Previously, the various parts of the bulk container hve been lashed together, with the miscellaneous parts free to become lost when moved by fork lifts or other means. When disassembled, the various parts are usually stacked either loose or lashed together by rope or other means.

Bulk containers are used in the transportation of a variety of products. In general, the containers must provide rigid confinement for the products during transport and be durable enough to withstand weather and repeated uses. Shifting of the loads of products within bulk containers can produce substantial lateral loads on the side wall panels of the containers. In some applications, the bulk containers are emptied by being tipped over to dump the products. In these instances, the containers must also withstand collapsive forces on their side wall panels, as well as the tendency of the wall panels to pull away from the bottom of the container. The major components of the containers are the base assembly, which also acts as the storage unit for the knocked-down container, the four side panels and the locking clips which secure the side panels at the corners. In a disassembled state, the free parts are placed within the base assembly to form a self-contained unit. Such a compact unit prevents the loss of any parts of the disassembled bulk container, minimizes damage to the panels, and provides for the safety of the workers when a large number of the units are stacked and being fork lifted.

SUMMARY OF THE INVENTION

The invention provides a bulk container that is both inexpensive to fabricate and easy to manufacture. Each of the side wall panels are rectangular in shape. In the case of a square container, all four sides are interchangeable; in the case of a rectangular container, the panels are interchangeable in pairs. A miter strip is fixedly mounted adjacent to each of the two normally vertical edges of the inside surface of each panel. The miter strips have a cross-sectional area of a 45° right triangle with the hypotenuse surface fixedly mounted to the panel surface. The miter strips are longer than the height of the panels such that they extend below the normally bottom edge of each panel. A vertical slot is cut downwardly from the upper edge of the panel alongside each of the miter strips. In certain embodiments of the invention, for containers which are tipped over in use, a horizontal channel is placed adjacent the normally lower edge of each panel, preferably near the center of each panel. The vertical slots extending from the upper edge of each side wall panel are easily cut and relatively short in length. The horizontal channel, if any, placed along the lower edge of each side panel may either be formed as a shallow trough or a slot completely cut through the thickness of the panel.

The bottom assembly of the container is composed of a floor, a relatively short upright continuous flange along the periphery of the floor, and parallel narrow strips along the underside of the floor for accepting the tines of a fork lift. For those containers which are tipped over in use, bottom clips are affixed along the center portion of each vertical wall to cooperate with the horizontal channels in the side panels. The flange of the bottom assembly forms the lowermost portions of the side walls of the assembled containers. The portion of the miter strips extending beyond the lower edge of the side panels support the side panels atop each side flange portion of the bottom.

The miter strips fastened to the side panels at either side, and the bottom clips, if any, affixed to the base assembly at each side make the container easy to assemble. If the container is being constructed of molded polymers, the miter strips can be an integral part of the side panels. The miter strips and bottom clips cooperate with the base assembly so that all four side panels may be set upright, self-supported along the base before any of the corner locking clips are installed.

The bulk container's bottom and side panels may be fabricated of any suitable rigid material such as wood or plastic. The locking clips and bottom clips may be formed of any material of slight flexibility such as steel. These and other features of the invention will become more clear taken in conjunction with the accompanying drawings and the detailed description.

DETAILED DESCRIPTION OF AN EMBODIMENT OF THE INVENTION

Figure 1:
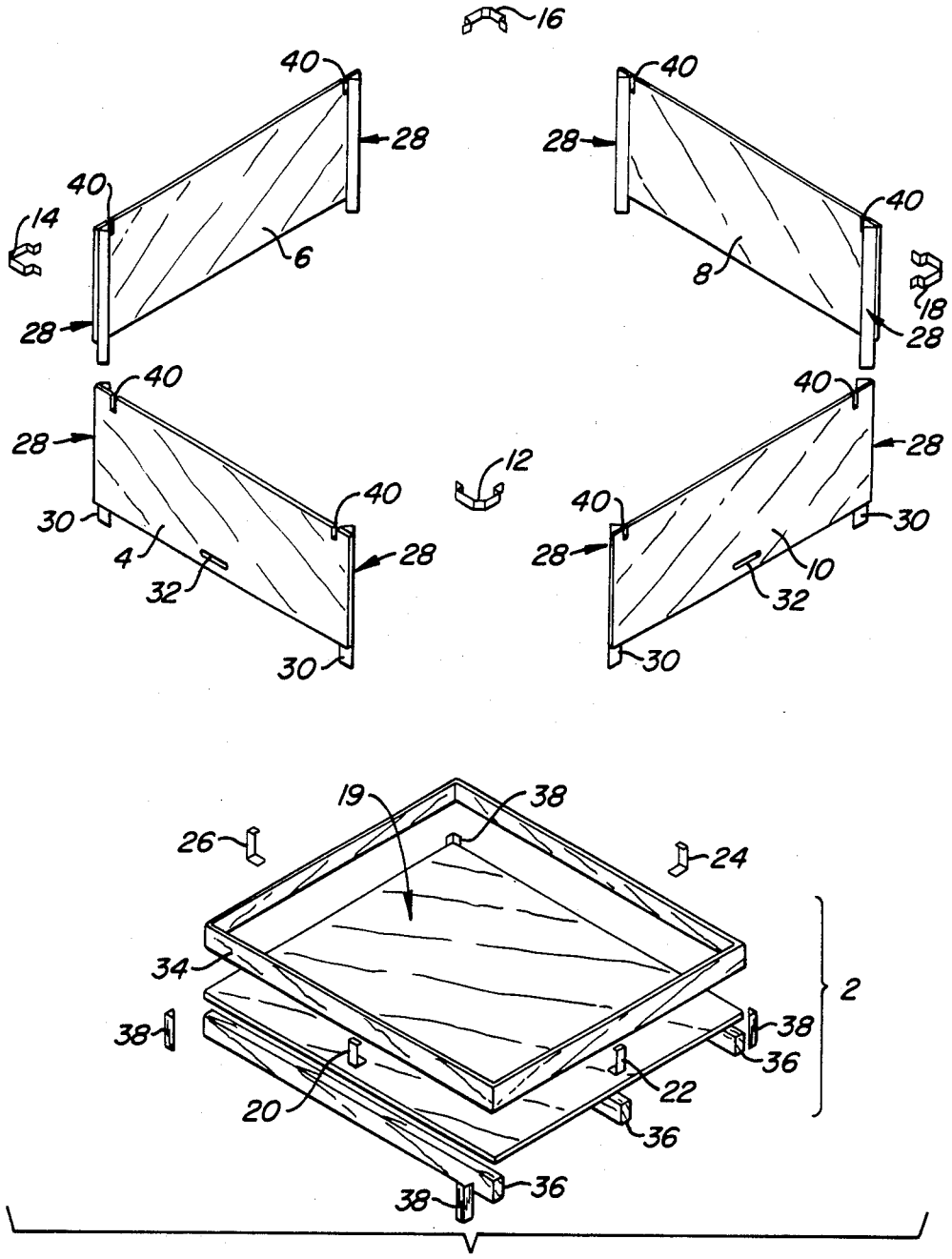
FIG. 1 is an exploded isometric view of the parts of the container.

The various parts of the container are shown in the exploded isometric view given in FIG. 1. The major components of the bulk container are a base assembly 2 and four side panels 4, 6, 8 and 10. In the embodiment illustrated herein, the container is square such that all side panels are interchangeable. The container could also be rectangular such that the panels interchange in pairs. The four corners formed by the panels are joined with locking clips 12, 14, 16 and 18. Bottom clips 20, 22, 24 and 26 secure the panels to the base assembly 2. A miter strip 28 is fixedly mounted adjacent to each interior side edge of each panel, extending beyond the lower edge of each panel to form a leg 30.

Bottom base assembly 2 shown in the lower portion of FIG. 1 is fabricated of several elements, although in some cases (i.e., when molded of plastic) the entire assembly might be of unitary construction. In this embodiment, base assembly 2 consists of a floor panel 19 surrounded on all sides by an upright flange 34. Flange 34 need not be continuous along the periphery of floor panel 19. Flange 34 provides lateral support for miter strips 28, and forms the lowermost portion of each side wall of the container. When the container is disassembled, flange 34 serves to retain the panels within the confines of the base assembly 2. A number of parallel strips 36 are provided on the bottom surface of floor panel 19 to make the container suitable for use with fork lifts. Floor panel 19, flange 34 and strips 36 may be held together by corner angle irons 38 fixed at each corner.

Figure 2:
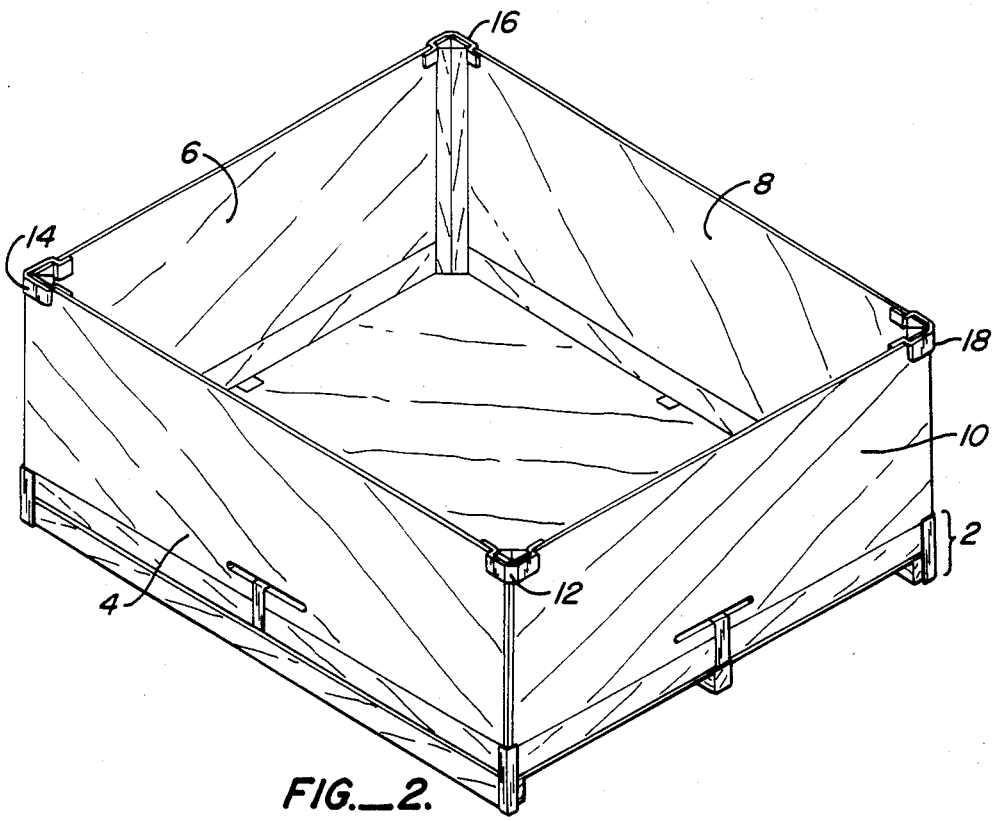
FIG. 2 is an isometric view illustrating of the assembled container.

Bottom clips 20, 22, 24 and 26 are fixedly mounted in the illustrated container between flange 34 and floor panel 19. Each of clips 20, 22, 24 and 26 is U-shaped in cross section and of such a length as to extend above the height of flange 34 when installed. These clips also act to retain the panels in the base when the container is disassembled. Side panels 4, 6, 8 and 10 are provided with respective horizontal slots 32 to engage with bottom clips 20, 22, 24 and 26 as shown in FIG. 2. The bottom edge of each side panel abuts the upper edge of flange 34, being further supported above floor panel 19 by the lateral support of legs 30 against the inside surfaces of flange 34.

The downward and inward compressive forces applied by bottom clips 20, 22, 24 and 26, acting as tension members against the horizontal slots, provide support for the side panels in upright positions. When the container is tipped over, the bottom clips engaging with the channels in the panels keep the panels from falling out of base assembly 2. The angled faces of the adjacent surfaces of miter strips 36 further provide vertical and lateral support for the proper positioning of the side panels.

Figure 4:
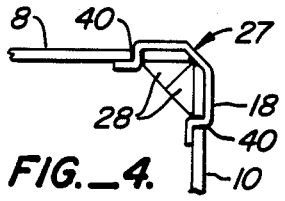
FIG. 4 is a detail of one corner of the container.

Each side panel is formed with a relatively short, vertical slot 40 along its upper edge adjacent to each miter strip 28. Locking clips 12, 14, 16 and 18 join side panels 4, 6, 8 and 10 in pairs at each corner. A more detailed illustration of a corner of the container is provided in FIG. 4. As shown in FIG. 4, locking clip 18 is a beveled clip which spans 90° and terminates in L-shaped arms at each end that are adapted to slide within vertical slots 40 of each pair of two adjacent side panels. When not installed, the locking clips may span slightly more than 90° to assure a tight fit against the panels. The locking clips are somewhat elastic, such that once installed they exert forces that act on the side panels tending to pull the miter strips into 90° alignment. The beveled construction of the clips provides an additional surface 27 for the clips to engage to prevent relative movement of the side panels. The locking clips thus act on the side panels to resist outward forces exerted by the contents of the container as well as inward forces exerted on the panels.

The assembled bulk container is shown in FIG. 2. To assemble the container, side panels 4, 6, 8 and 10 are engaged one by one with bottom clips 20, 22, 24 and 26 of base assembly 2. The side panels are somewhat self-supporting during assembly due to the support provided by the bottom clips and the miter strips abutting the flange 34. The insertion of the fourth panel requires additional force due to the interaction of the already installed panels on either side. Each miter strip 28 abuts against the adjacent miter strip to provide support in maintaining the panels upright until locking clips 12, 14, 16 and 18 are installed by being slid into the vertical slots. Miter strips 28 and locking clips 12, 14, 16 and 18 cooperate to further resist forces from outside the container tending to collapse the side panels inwardly.

Figure 3:
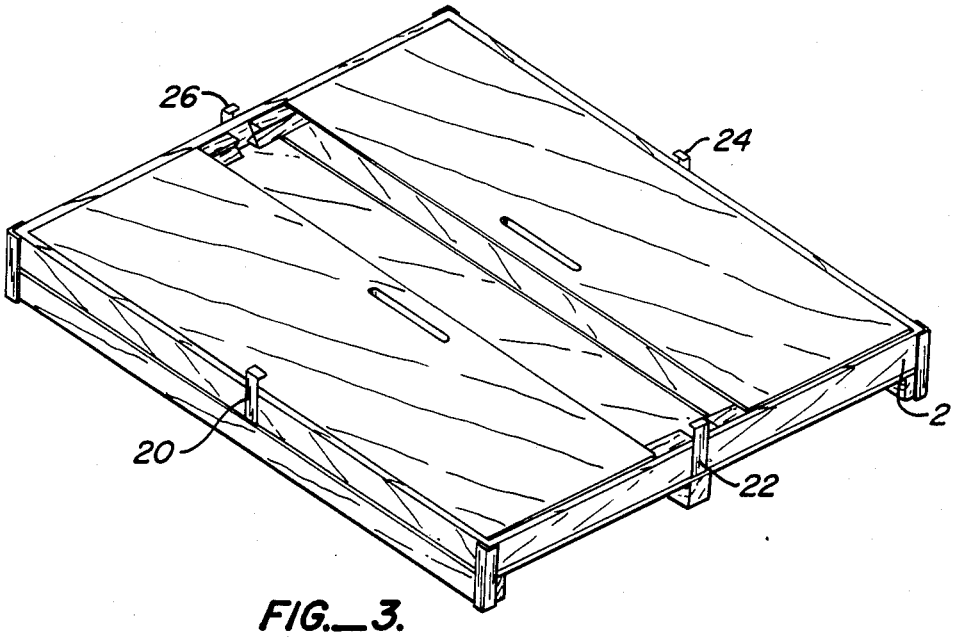
FIG. 3 is an isometric perspective view of the disassembled container.

The disassembled version of the bulk container ready for stacking is illustrated in FIG. 3. Base assembly 2 acts as a containment for the disassembled parts. Flange 34 serves to retain the loose pieces of the container. The side panels lie stacked in pairs atop floor panel 19. The locking clips (not shown) may be stored between the sandwiched side panels. Bottom clips 20, 22, 24 and 26 extend in part above the panels to further restrain the panels from sliding out of base assembly 2. The height of the upright side panels is limited by the internal dimensions of the base assembly so that the compact configuration of the disassembled container may be achieved.

The foregoing is a complete description of the invention, but is not intended to limit the scope of the invention, except as stated in the appended claims. While the above provides a full and complete disclosure of the preferred embodiment of the invention, various modifications, alternate constructions, and equivalents may be employed without departing from the true spirit and scope of the invention. For example, the embodiment described herein and shown in the drawings discloses a bulk container in which all four sides and the bottom are completely solid. Depending on the purpose for which the bulk container is intended, the sides and bottoms could easily be provided with open areas to provide air and ventilation for the enclosed products. Therefore, the above description and illustrations should not be construed as limiting the scope of the invention which is defined by the appended claims.

What is claimed is:

1. In an improved portable and disassemblable bulk container having a bottom and side panels, the improvement comprising:

at least one upright flange along the upper periphery of the bottom;

miter strips secured adjacent to the normally vertical side edges of each of the panels and extending beyond the lower edge of the panels to support the panels in alignment with and above said flange;

each of the side panels having vertical slots extending from the upper edges of the panels and spaced apart from each side edge of each of the panels; and removable, interchangeable locking clips spanning the beveled exterior of the corners formed by the adjacent panels with abutted miter strips placed in alignment with and above said flange and terminating in L-shaped bends to be slidably accepted in said vertical slots and to extend along the interior surface of the panels.

2. The bulk container of claim 1, wherein said flange is fixedly mounted to the bottom.

3. The bulk container of claim 1, wherein the bottom is provided along its lower surface with parallel strips spaced along the width of the underside of the bottom to adapt the container for use with a fork lift.

4. The bulk container of claim 1, wherein said miter strips form an isosceles right triangle in cross section.

5. The bulk container of claim 1, wherein the overall height of each panel, including said miter strips, does not exceed half the width of the bottom.

6. The bulk container of claim 1, wherein said panels are provided with channels along the normally outer panel surface, spaced apart from the normally lower edge of each of the panels.

7. The bulk container of claim 6, further comprising bottom clips fixedly mounted to each exterior side of each of said flange and extending above said flange and towards the interior of said container for mating engagement with said channels of said panels.

8. The bulk container of claim 6, wherein said bottom clips are U-shaped in cross section and fixedly mounted between said flange and the bottom.

* * * * *